US007913636B2

(12) United States Patent
Meyer

(10) Patent No.: US 7,913,636 B2
(45) Date of Patent: Mar. 29, 2011

(54) HIGH SPEED WATERCRAFT SUITABLE FOR ROUGH WATER CONDITIONS

(76) Inventor: Thomas Wilmot Meyer, Cape Town (ZA)

( * ) Notice: Subject to any disclaimer, the term of this patent is extended or adjusted under 35 U.S.C. 154(b) by 375 days.

(21) Appl. No.: 12/158,575

(22) PCT Filed: Dec. 23, 2005

(86) PCT No.: PCT/IB2005/003866

§ 371 (c)(1),
(2), (4) Date: Jun. 20, 2008

(87) PCT Pub. No.: WO2007/072105

PCT Pub. Date: Jun. 28, 2007

(65) Prior Publication Data

US 2009/0227159 A1 Sep. 10, 2009

(51) Int. Cl.
*B63B 1/20* (2006.01)

(52) U.S. Cl. ..... 114/283; 114/279; 114/284

(58) Field of Classification Search ..... 114/61.1, 114/271, 272, 274, 279, 280, 283, 284, 288
See application file for complete search history.

(56) References Cited

U.S. PATENT DOCUMENTS

| | | | | |
|---|---|---|---|---|
| 2,083,162 | A | 6/1937 | Grant | |
| 3,401,663 | A | 9/1968 | Yost | |
| 3,517,632 | A | 6/1970 | Dudley | |
| 3,922,994 | A * | 12/1975 | De Long | 114/281 |
| 3,998,176 | A | 12/1976 | Stout et al. | |
| 4,685,641 | A * | 8/1987 | Kirsch et al. | 114/272 |
| 4,763,594 | A * | 8/1988 | Zickermann | 114/272 |
| 7,314,014 | B2 * | 1/2008 | Heyring et al. | 114/284 |

FOREIGN PATENT DOCUMENTS

| | | |
|---|---|---|
| FR | 2 746 763 A | 10/1997 |
| JP | 2081789 | 3/1990 |

* cited by examiner

*Primary Examiner* — Lars A Olson
(74) *Attorney, Agent, or Firm* — Gottlieb, Rackman & Reisman

(57) ABSTRACT

A watercraft suitable for operation in rough water conditions is disclosed. The watercraft comprises a central platform (13) and two pairs of hull units (60), a forward pair and an aft pair. The hull units are located on opposite sides of tie platform and extend below the platform, with each hull unit comprising a mount (54) attached to the platform and a trailing hull connected to the mount via a movable hull support. The components of the hull units are connected by joints (58,62) arranged to constrain lateral and axial movement of: the hull relative to the platform (12) but to permit pivoting thereof about the mount (54). Each hull unit has a suspension assembly arranged to support the respective hull units, and comprises a suspension member (66) extending from the platform (12) to a mounting point (20) on the hull aft of the respective mount, and being arranged to accommodate movement of the hull relative t) the platform and to apply damping to movement of the hull.

13 Claims, 4 Drawing Sheets

HIGH SPEED WATERCRAFT SUITABLE FOR ROUGH WATER CONDITIONS

BACKGROUND OF THE INVENTION

This invention relates to a watercraft suitable for high speed operation in relatively rough water conditions. In particular, the invention relates to a boat which is designed to travel at relatively high speed in rough or turbulent conditions.

SUMMARY OF THE INVENTION

According to the invention there is provided a watercraft suitable for operation in rough water conditions, the watercraft comprising:

a central platform;

at least one pair of hull units, the hull units being located on opposite sides of the platform and extending below the platform, with each hull unit comprising a mount attached to the platform and a trailing hull connected at a leading edge thereof to the mount by at least one joint arranged to constrain lateral and axial movement of the hull relative to the platform but to permit pivoting thereof about the mount, the hulls having sufficient buoyancy to support the boat in the water with the platform clear of the water; and at least one pair of suspension assemblies arranged to support the respective hull units, each suspension assembly comprising a suspension member extending from the platform to a mounting point on the hull aft of the respective mount, and being arranged to accommodate movement of the hull relative to the platform and to apply damping to movement of the hull.

The watercraft may comprise two pairs of hull units, a forward pair and an aft pair.

Preferably, each hull unit includes a movable hull support located between the mount attached to the platform and the trailing hull, the movable hull support being connected at a leading end thereof to a trailing end of the mount by a first hinged joint, and being connected at a trailing end thereof to a leading end of the hull by a second hinged joint.

Each hull unit preferably has a generally "S" shaped profile in a direction transverse to its longitudinal axis, with a leading end defined by the mount attached to the platform and a trailing end defined by the trailing end of the respective trailing hull, the trailing end of the hull unit being lower than the leading end thereof.

The length of the movable hull support in a direction parallel to the longitudinal axis of the platform is preferably about 20% to 40% of the length of the trailing hull in the same direction.

The maximum range of vertical movement at the leading end of each hull is preferably about 10% to 30% of the maximum range of vertical movement at the trailing end of the hull.

In a preferred embodiment of the watercraft, the width of each hull at its leading end, in a direction transverse to the longitudinal axis of the platform, is approximately 50% to 100% of the maximum width of the hull in the same direction.

Most preferably, the width of each hull at its leading end is approximately 60% of the maximum width of the hull.

Further, in a preferred embodiment of the watercraft, the vertical sectional depth of each hull at its leading end is 2% to 20% of the maximum vertical sectional depth of the hull.

Most preferably, the vertical sectional depth of each hull at its leading end is approximately 10% of the maximum vertical sectional depth.

Each hull unit preferably curves rearwardly and outwardly from its leading end, relative to the longitudinal axis of the platform.

The watercraft may include an auxiliary suspension unit between the hull and the movable hull support, the auxiliary suspension unit being configured to control relative movement between the hull relative and the movable hull support.

The auxiliary suspension unit preferably includes a spring and a damping device.

The auxiliary suspension unit may also include a stop mechanism that is preferably pre-tensioned so that the hull assumes a fully extended position relative to the movable hull support when the watercraft is stationary.

The suspension assemblies that support the hulls relative to the platform may each comprise a trailing arm connected pivotably to the platform at or adjacent a first end thereof, and to a respective hull at or adjacent a second end thereof.

Each suspension assembly may include a suspension element connected between the platform and the trailing arm at a point intermediate the ends of the trailing arm.

The suspension element may comprise a spring and a damping device.

Alternatively, the suspension element may comprise at least one hydraulic actuator.

Each suspension assembly may be pre-tensioned so that each respective hull assumes a fully extended position relative to the platform when the watercraft is stationary.

The watercraft may include flexible walls extending between at least one pair of hull units and the platform, thereby defining an air flow tunnel beneath the watercraft between the hull units.

Preferably, the flexible walls comprise a plurality of overlapping slats, each slat being mounted pivotably to accommodate relative movement between the hull units and the platform.

The watercraft may include at least one flap at the stern of the watercraft arranged to close the rear end of the tunnel at least partially, to maximise the lift provided by air trapped in the tunnel in use.

The flap or flaps are preferably arranged to engage a respective aft hull when the hull undergoes substantial excursions, to lift the flap clean of the water in use.

The watercraft may include at least one propulsion unit mounted in or on the platform, and a pair of propellers, one propeller being mounted on each respective trailing end of a hull unit, the propellers being connected by telescopic drive shafts to said at least one propulsion unit.

BRIEF DESCRIPTION OF THE DRAWINGS

FIG. 4(*b*) is a partial sectional view, similar to that of FIG. 4(*a*), of an alternative embodiment;

DESCRIPTION OF AN EMBODIMENT

Figure 1:
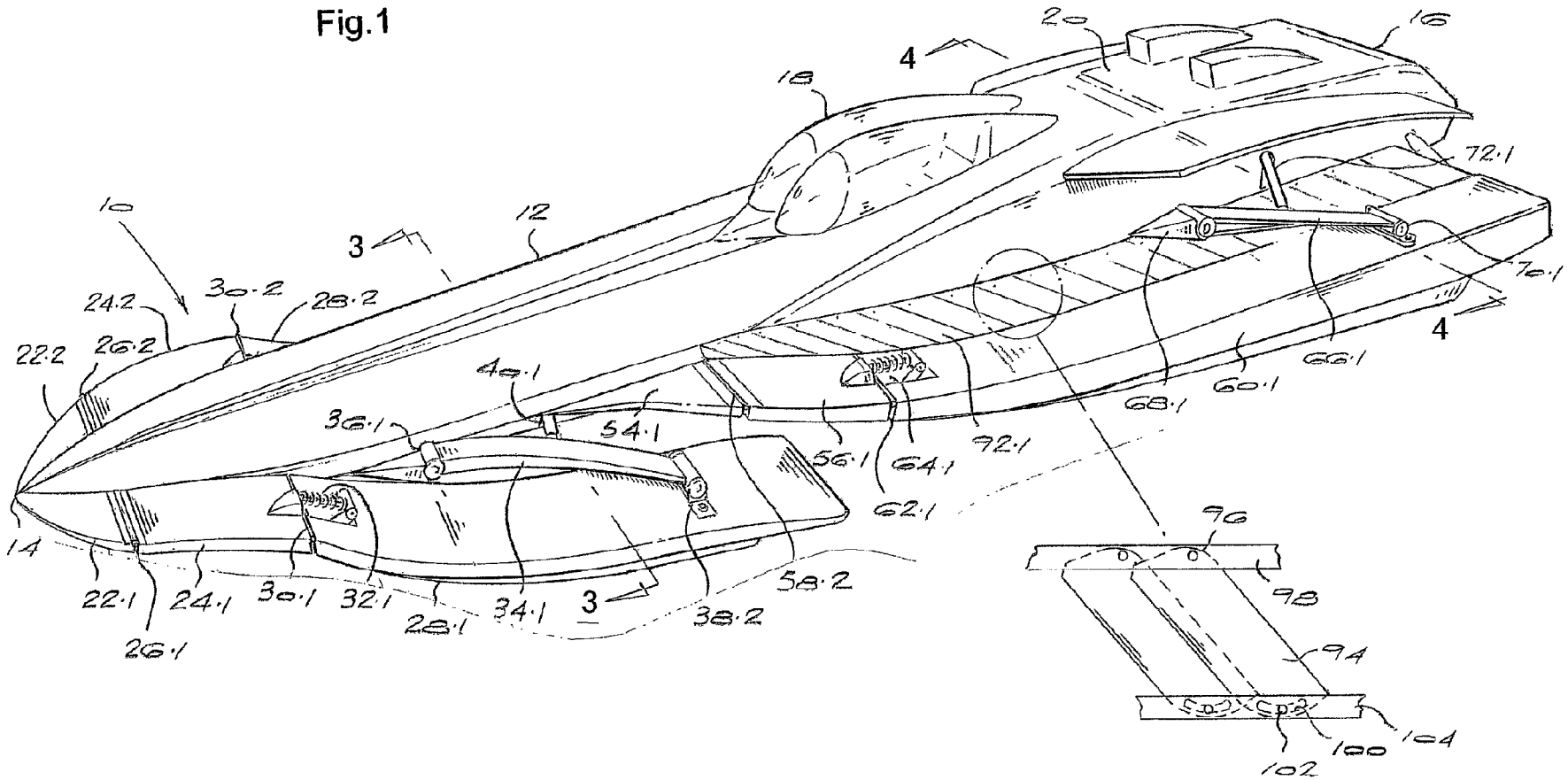
FIG. 1 a pictorial view of a boat according to the invention.

The illustrated watercraft was designed for high speed operation in relatively rough water conditions.

Concisely, this is achieved by providing a central body or platform to which are attached two sets of independently suspended hull units, a forward pair and an aft pair. Each hull unit is mounted to the platform at a leading end thereof, and has a trailing end extending aft which can move through a substantial range of travel. A sprung and damped suspension controls the movement of each hull relative to the central platform.

Each hull is hydrodynamically shaped for high speed operation and has a mass which is relatively low compared to the mass of the central platform. Thus, the boat of the invention is somewhat analogous to a road-going motor vehicle having a suspension system with a low unsprung mass.

Referring now to the drawings, an embodiment of a boat 10 according to the invention comprises a narrow elongate central platform 12 having a bow 14 and a stern 16. A cockpit 18 is located between the bow and the stern, and an engine compartment 20 is provided between the cockpit and the stern.

At either side of the bow 14 are a pair of curved blade-like, fixed hull supports 22.1 and 22.2 which extend laterally outwardly from the platform 12. A pair of movable hull supports 24.1 and 24.2 are connected pivotably at leading ends thereof, by means of respective hinges 26.1 and 26.2, to the trailing ends of the respective fixed hull supports 22.1 and 22.2. These hinges permit the movable hull supports to pivot relative to the fixed hull supports, but constrain the movable hull supports against lateral and axial movement relative to the fixed hull supports and the platform 12.

Connected pivotably to the trailing end of each of the movable hull supports 24.1 and 24.2 is a respective forward hull 28.1 and 28.2. The hulls are connected to the respective movable hull supports at leading ends thereof, by means of hinged joints 30.1 and 30.2, and are provided with suspension units 32.1 and 32.2 acting between the hulls and the movable hull supports, each comprising an adjustable coil spring and damper (shock absorber) assembly.

In addition to being supported at their leading ends by the hinges 30 and the suspension units 32, the hulls 28.1 and 28.2 are each supported by a respective trailing arm 34.1 and 34.2. Each trailing arm is connected to a pivot point 36.1 or 36.2 on the platform at the leading end thereof, and at the trailing end thereof to a swivel mount 38.1 or 38.2 mounted on the upper surface of the respective hull. The pivot point 36.1 or 36.2 incorporates an elastomeric bush, typically a "Rubaride" type axle unit which assists in suspension load sharing. The swivel mount 38.1 or 38.2 comprises a pivoting joint to which the aft end of the trailing arm is connected, and a resilient mounting connected to the respective hull. The resilient mounting comprises an elastomeric bush of a conventional kind. The elastomeric bushes provide rust free, seizure free bearing units.

The resilient mounting accommodates fore and aft movement of the pivot point due to the differential arcs of movement of the hull and the trailing arm. The pivoting joints at both ends of the trailing arms are oriented with their axes extending at right angles to the longitudinal axis of the platform 12, and thus permit vertical movement of the hulls relative to the platform, but constrain the hulls against lateral and axial movement relative to the platform.

Struts 40.1 and 40.2 extend inwardly from mounting points on the respective trailing arms intermediate the ends thereof and are connected pivotably to outboard ends 42.1 and 42.2 of respective rockers 44.1 and 44.2 mounted on supports 46.1 and 46.2 within the platform 12. Connected to respective inboard ends 48.1 and 48.2 of the rockers are adjustable suspension units 50.1 and 50.2 each comprising a coil spring and damper, with the lowest most ends of the suspension units being connected to respective brackets 52.1 and 52.2.

In an arrangement similar to that of the forward pair of hull units, the illustrated boat also includes an aft pair of hull units. Extending transversely outwardly from the platform 12 adjacent the trailing ends of the forward hulls 28.1 and 28.2 are respective fixed hull supports 54.1 and 54.2, to which are mounted respective moveable hull support members 56.1 and 56.2 by means of respective transversely oriented hinges 58.1 and 58.2. Respective aft hulls 60.1 and 60.2 are attached pivotably to the movable hull support members 56.1 and 56.2 by means of hinges 62.1 and 62.2 and respective suspension units 64.1 and 64.2, each comprising a coil spring and damper assembly.

Respective trailing arms 66.1 and 66.2 extend rearwardly and outwardly from mounting points 68.1 and 68.2 on the sides of the platform 12 and are connected to the hulls 60.1 and 60.2 by means of pivoting brackets 70.1 and 70.2 in a similar manner to the arrangement of the forward hulls. Struts 72.1 and 72.2 extend through openings in the sides of the platform 12 between the trailing arms 66.1 and 66.2 in a suspension arrangement comprising rockers and spring/damper units as shown in FIG. 4, in an arrangement similar to that of FIG. 3.

The fixed hull supports 54, movable hull supports 56, and the aft hulls 60 make up a pair of aft hull units.

Figure 3:
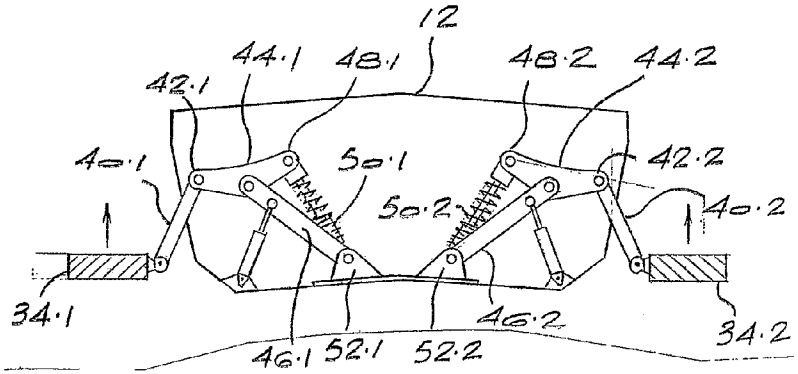
FIG. 3 is a sectional view on the line 3-3 in FIG. 1.
Figure 4B:
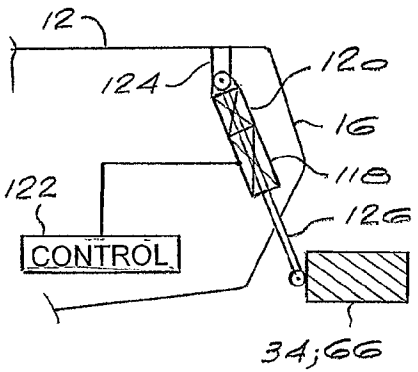
FIG. 4(*a*) is a sectional view on the line 4-4 in FIG. 1.
Figure 4A:
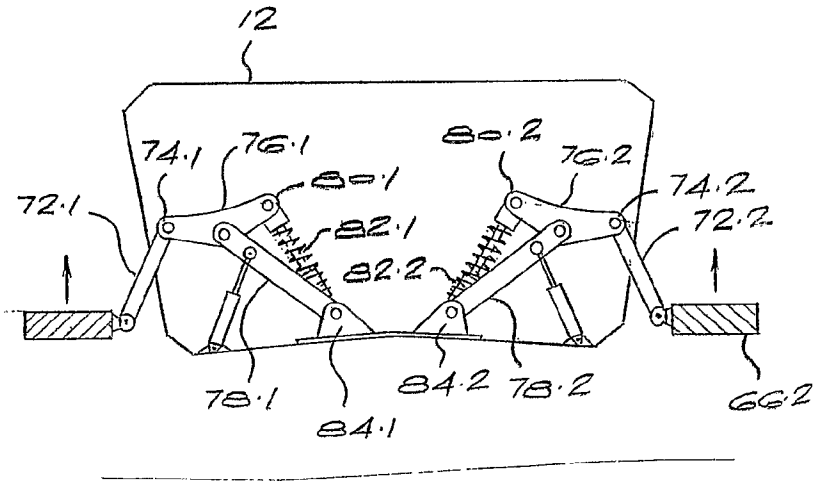

Although FIGS. 3 and 4 show an inboard suspension system configuration, an outboard configuration could also be used, with the suspension units, each comprising a spring and damper assembly, mounted outside the platform, between the platform and the respective hull.

Instead of the mechanical spring/damper suspension system shown in FIGS. 3 and 4(*a*), an active suspension system could be used instead. For example, FIG. 4(*b*) shows an active suspension system comprising a main actuator 118 and an auxiliary actuator 120, both arranged to be operated by a hydraulic control unit 122 located within the platform 12. The two actuators operate between a mounting point 124 in the platform and a respective trailing arm 34; 66 via an actuator rod 126. The main actuator 118 controls the dynamic suspension characteristics of the water craft in use, while the auxiliary actuator 120 is used to adjust the ride height setting of the craft.

The suspension system of FIGS. 3 and 4 further incorporates an over-extension limiting device enabling the suspension system to be pre-tensioned and preventing over-extension of the hulls with respect to the platform in extreme operating conditions. The suspension system is preferably pretensioned (typically by about 110%) to ensure that the suspension is fully extended when the craft is at rest.

A ride height facility is also integrated into the suspension system, enabling vertical height adjustment of the platform relative to the hulls. This allows the platform height with respect to the water surface to be increased or decreased in use.

The described arrangement permits a degree of controlled vertical movement of the leading end of each hull 28, and a greater degree of vertical movement of the trailing end of each hull.

The maximum vertical movement at the pivot points 30 and 62 is typically within the range of 10% to 30% of the maximum vertical movement at the trailing ends of the hulls.

Figure 7:
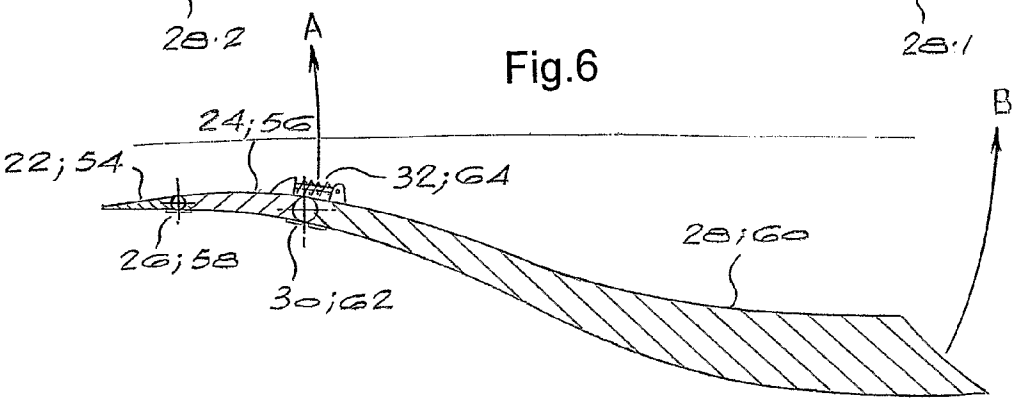
FIG. 7 is a schematic sectional view of a hull unit of the boat.

The hinges 26; 58 and 30; 62 and the suspension units 32; 64 are designed to limit downward travel of the movable hull supports beyond the positions illustrated schematically in FIG. 7, to prevent over-extension of the hull units. The trailing ends of the movable hull supports 24; 56 can pivot upwardly from their illustrated rest positions, about the hinges 26; 58, along an arcuate path A, while the trailing ends of the hulls 28; 60 can pivot upwardly about the hinges 30; 62 along an arcuate path B having a substantially greater radius than that of the path A.

This is achieved by incorporating a suitable stop mechanism in each hinge joint, and by pre-tensioning the suspension units to ensure that the hull units adopt a neutral alignment when the craft is at rest. The use of the pre-tensioned suspension units gives a degree of rigidity to the hull units, and the hulls will only heave or pivot when subjected to transient impact forces. The use of sprung and damped hinges as described above avoids the need for a second relatively bulky trailing arm assembly with associated suspension components for the movable hull supports 24; 56, offering a light weight and relatively low cost alternative.

Each hull unit has a flattened generally "S" shaped profile in a direction transverse to its longitudinal axis, with a leading end defined by the mount attached to the platform and a trailing end defined by the trailing end of the respective trailing hull, the trailing end of the hull unit being lower than the leading end thereof.

Figure 2:
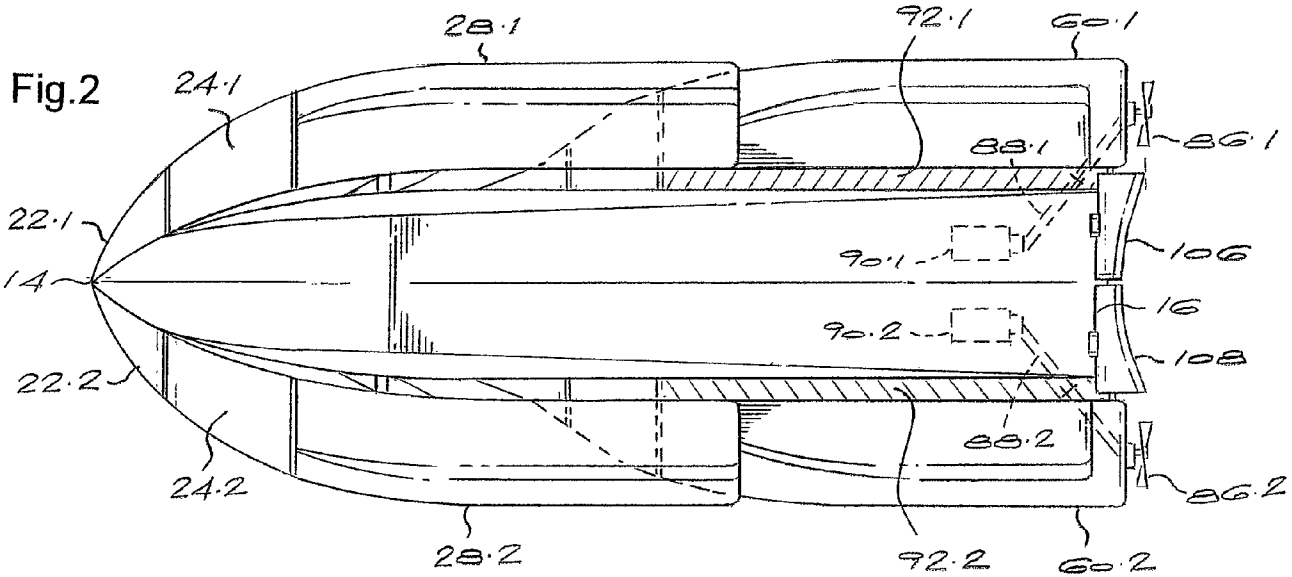
FIG. 2 is an under plan view of the boat of FIG. 1.

It can be seen from the drawings that the trailing ends of the forward hull units lie below the leading ends of the aft hull units. The suspension units of the forward hulls are designed to limit the upward travel of the forward hulls to prevent interference between the forward and aft hulls. The outer edges of the forward and aft hulls are substantially aligned, as best seen in the under plan view of FIG. 2. The forward hull units are somewhat shorter than the aft hull units, typically about 20% to 40% shorter.

It can be noted that each hull unit curves both rearwardly and outwardly, relative to the longitudinal axis of the platform, from its leading end. This provides a desirable free-flowing platform and hull configuration.

The length of the movable hull support members 24 and 56 is typically approximately 20% to 40% of the length of the respective hulls connected thereto. The leading ends of the movable hull support members are attached to the respective fixed hull support members relatively high on the body of the platform 12, while the movable hull support members and the hulls themselves curve downwardly towards their trailing ends so that a substantial portion of each hull is beneath the underside of the platform 12. The volume and buoyancy of the hulls is designed to ensure that when the boat is at rest in the water, the underside of the platform 12 is clear of the water. In general, the volume and buoyancy of the hulls is selected as a function of the craft's specific application and performance requirements.

The shape of each hull unit is designed for optimum hydrodynamic effect. Each moveable hull support and hull assembly forms an integral, free flowing S-shaped hull unit, providing optimum shock absorbing qualities in both horizontal and vertical planes. The hull units have an overall uniformly tapering profile, with the shape and profile of the fixed hull supports, movable hull supports and hulls flowing smoothly from one to the next. The width of each hull at its leading end, in a direction transverse to the longitudinal axis of the platform 12, is in the range from 50% to 100%, typically approximately 60% of the maximum width of the hull, while the vertical sectional depth at the leading end of each hull is in the range from 2% to 20%, typically approximately 10% of the maximum vertical sectional depth of the hull.

Each hull is formed with at least one chine which curves rearwardly and outwardly from the leading end thereof. The upper surface of each hull directly aft of the respective swivel mount 38 or 70 curves downwardly to a diminishing tapering trailing end. This profile assists in reducing hydrodynamically induced negative pressures which could be expected here. A further measure to reduce negative pressures in this region entails the incorporation of a vent duct within the abovementioned tapered region, with the inlet port of the duct being positioned above the water level of the hull.

For optimum hull dynamics, with desirably rapid vertical acceleration characteristics, the hull should have a low mass. At the same time, the hulls are subject to substantial stresses in use, and this will generally dictate a hull construction of a durable, high strength and light weight material such as carbon fibre, Kevlar or aluminium alloy.

In some embodiments, in order to minimise the mass of the hulls and to increase their impact resistance, they may be internally pressurised. For example, each hull may be filled with one or more flexible bladders which are pneumatically pressurised.

Due to the fact that the forward end of each hull is attached to and supported by a hull support mounted on the platform, approximately 30% of the mass of each hull is essentially static and inactive. The free floating trailing end of each hull represents approximately 70% of the effective hull mass, which is the portion of the hull which is subjected to dynamic movement.

It is important that the hull mass, particularly the dynamic mass, of each hull should be minimised as such, apart from the achievement of a high sprung:unsprung mass ratio.

Although a high sprung:unsprung mass ratio might appear to provide an index for an efficient craft, this index can be manipulated by adjusting the platform weight, typically using ballast or a payload.

Ideally, the craft should have the lowest possible unsprung dynamic mass relative to a given platform mass. Simply dividing the hull of the craft into two separate hulls will increase this ratio, and the use of four hulls will increase the ratio four-fold. The use of the described pivoting geometry can improve the dynamic unsprung mass figure by a further 30% or so.

The described arrangement permits a high sprung:unsprung mass ratio in the craft, typically in the region of 10:1 overall. This is achieved by a combination of the described hull design and the use of light weight materials in the hulls.

Figure 5:
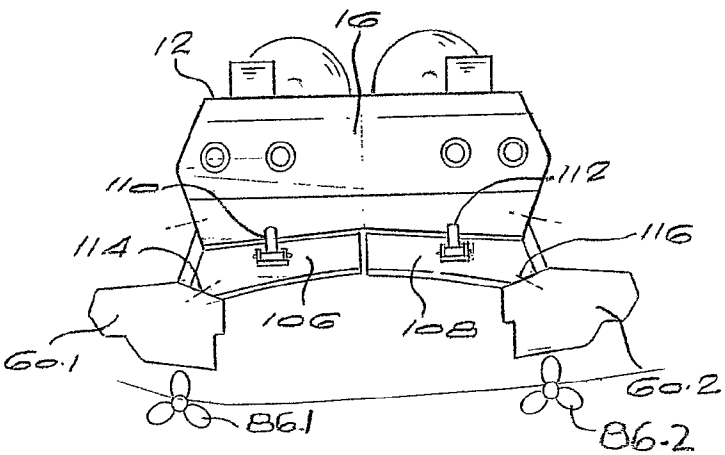
FIG. 5 is a rear view of the boat.
Figure 6:
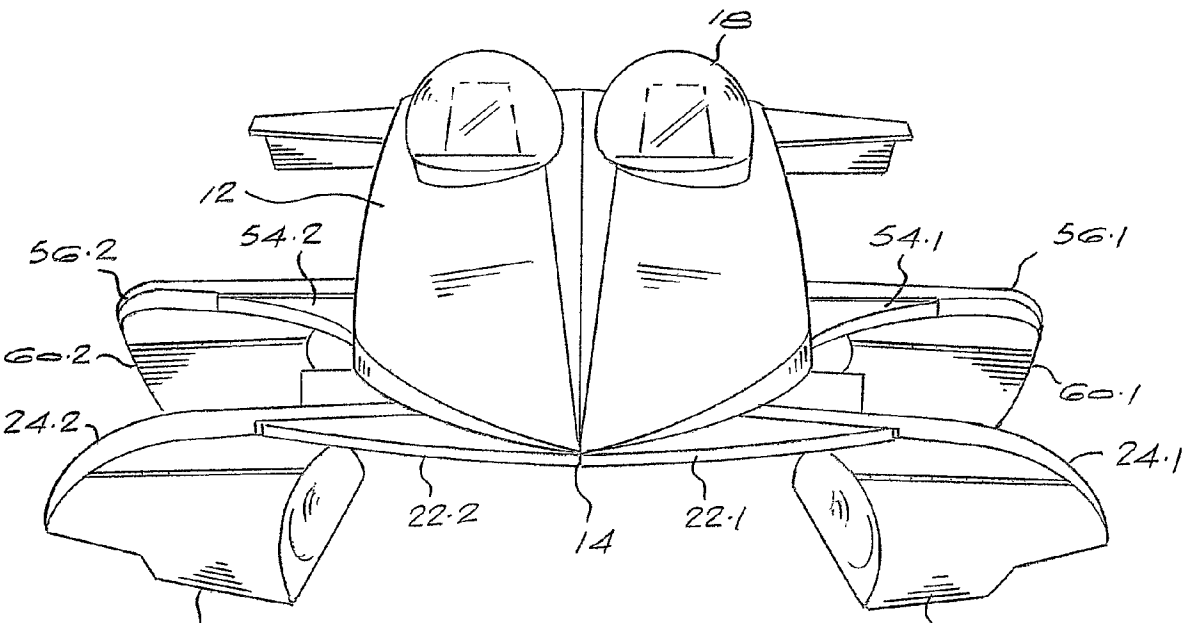
FIG. 6 is a front view of the boat.

As best seen in FIG. 5, propellers 86.1 and 86.2 are mounted at the trailing ends of the aft hulls 60.1 and 60.2 and are connected by telescopic drive shafts 88.1 and 88.2 to a pair of marine engines 90.1 and 90.2 located in the engine compartment 20.

In order to define a tunnel or airflow passage between the underside of the platform 12 and the aft hulls 60.1 and 60.2, flexible walls or curtains 92.1 and 92.2 are provided between the sides of the platform and the respective hulls. Each wall comprises a set of generally rectangular overlapping slats 94, each of which is pivoted at an upper corner 96 to an upper support rail 98 fixed to the side of the platform, with a curved slot 100 being formed in an opposed, lower corner thereof which receives a pin 102 mounted on a lower support rail 104 on the upper, inner edge of the respective hull. The pivoting/sliding configuration of the slats 94 allows them to move to accommodate relative movement between the hulls and the platform, while the overlap between adjacent slats insures adequate air tightness. The slats are preferably formed from a light, stiff but flexible material, such as carbon fibre or Kevlar composites.

When the boat is travelling at speed, air enters the tunnel defined between the underside of the platform 12 and the inner sides of the aft hulls, and induces a positive aerodynamic pressure, to assist in reducing hydrodynamic drag losses. To enhance the aerodynamic pressure, a pair of downwardly extending flaps 106 and 108 are provided at the stern of the boat to close the rear end of the airflow passage or tunnel to a large extent, and thus to maximise the lift provided by air trapped in the tunnel. The respective flaps are supported independently by sprung and damped suspension units 110 and 112 which control sudden movement of the flaps. The lower outer corners 114 and 116 of the respective flaps can engage the inner edges of the respective hulls 60.1 and 60.2 when the latter ride upwardly when the boat is in operation, and rollers or other bearing means can be provided on the flaps and/or the hulls to permit the components to move relative to one another without damage. This arrangement moves the flaps upwardly out of contact with the water during major excursions of the hulls.

The described boat is designed to travel at high speeds, with a relatively small wetted area due to the combined effect of air trapped under the platform and the efficient hydrodynamic shape of the individual hulls. In addition, the use of multiple independently suspended hulls, each of which is much lower in mass than the central platform of the boat, allows the boat to deal effectively with rough or turbulent water conditions, imparting a minimum of shock to the platform and hence to the occupants of the boat. The described four-hull configuration provides four points of contact between the craft and the water, ensuring that the craft is stable in both lateral and longitudinal planes.

It will be appreciated that the relative sizes and proportions of the platform and the hull, the relative masses thereof, the degree of travel of the suspension components and the geometry of the hulls can be adjusted according to requirements. For example, the boat can be optimised for maximum speed, or for carrying a predetermined payload.

The configuration of the described watercraft is well suited for extensive geometrical modulation, and provides a craft usable in both mild and extreme operational conditions. The design provides a large shock absorbing capacity and a high system efficiency. The described craft is primarily performance oriented, with a lesser emphasis being placed on volumetrics and payload requirements.

Although a watercraft having four hulls has been described, the principles of the invention can be applied to a two-hulled configuration as well. In a two-hulled version, the hulls will extend substantially the full length of the craft, each having a flexible skirt or curtain between itself and the platform of the craft. In other respects, the suspension of the hulls will be substantially the same as that described above for a single pair of hulls.

The described embodiment has inboard propulsion units but it is also possible to make use of outboard units, which could either be mounted on the platform, or on the trailing ends of the aft hulls. In the case of a sailcraft, self-contained power units will be omitted.

The invention claimed is:

1. A watercraft comprising:

a central platform having lateral constraints, four hull units in the form of a forward hull unit pair and an aft hull unit pair, each at least comprising a displaceably mounted trailing hull that extends trailingly relative to the platform while the hull units of the respective hull unit pairs are located on opposing sides of the platform, the hull units of the aft hull unit pair being arranged to have their leading ends located over and at least substantially above the trailing ends of the corresponding hull units of the forward hull unit pair, as observed in a direction transverse to the longitudinal axis of the watercraft, each hull unit curving outwards and rearwards from its leading end at which position it is pivotally mounted to the lateral constraints of the platform, the leading ends of the hull units being located above the water line of the watercraft while their trailing ends extend downwards and rearwards to below the level of the platform to support the watercraft in the water when at rest, each trailing hull being at least indirectly hingedly connected to the platform at its respective leading bow end by means of a hinge that is each configured to permit vertical hull movement at its leading end while constraining lateral and axial hull movement relative to the platform, the watercraft also including a suspension system that at least comprises a spring and damper unit for each trailing hull and which spring and damper units, as extending between the platform and a trailing end of a respective trailing hull, being arranged to control the vertical movement of the trailing ends of the trailing hulls relative to the platform and being configured to also constrain lateral and axial movement of the trailing ends of the trailing hulls relative to the platform.

2. A watercraft according to claim 1 in which the hull units of the forward hull unit pair is shorter than the hull units of the aft hull unit pair.

3. A watercraft according to claim 1 wherein the trailing hulls are each also fitted with an intermediate hinged point along its leading bow end region of which the position is selected to enhance the vertical movement at the bow end of each trailing hull, while still maintaining a sweeping action and hydrodynamic profile of a conventional trailing hull, each trailing hull thus being constituted by a forward hull section and a main hull section which hull sections are thus interconnected by hinged points that are configured to permit interpivoting of the trailing hull sections while constraining the lateral and axial movement of the trailing end of the trailing hulls relative to the platform in a direction transversely to the longitudinal axis of the watercraft.

4. A watercraft according to claim 3 wherein the hull units are constituted to permit a substantial portion of their leading bow ends to be situated above the waterline when the watercraft is traveling at speed.

5. A watercraft according to claim 3 wherein a stop mechanism providing a stop position is located between each forward hull section and its main hull section that is situated to cause the forward hull section to assume a neutral position relative to its main hull section, and also to restrict downward movement of the leading end of the main hull section relative to the neutral position, thus permitting only upward movement of the leading end of the main hull section relative to the neutral position in a direction transverse to the longitudinal axis of the watercraft.

6. A watercraft according to claim 5 wherein a spring and damper unit is located between each forward hull section and its main hull section, that is configured to apply a spring tensioned force against a relevant stop position in order to accomplish a pre-tensioned neutral position of the main hull sections relative to their forward hull sections.

7. A watercraft according to claim 6 wherein each spring and damper unit is also configured to control relative movement between the forward hull sections and their main hull sections.

8. A watercraft according to claim 3 wherein the forward hull sections including their respective hinge points by means of which they are connected to the platform, are located above the upper surface of the trailing ends of the aft hull units, as observed in a direction transverse to the longitudinal axis of the platform.

9. A watercraft according to claim 1 wherein the spring and damper suspension system that supports the platform above the trailing hulls, includes stop mechanisms, each of which is configured to cause the trailing hulls to assume pre-tensioned neutral positions relative to the platform when the watercraft is at rest in the water while restricting downward movement of the trailing hulls and thus only permitting upward movement of the trailing hulls from their neutral positions relative to the platform.

10. A watercraft according to claim 1 that includes a system of flexible walls extending between the platform and the trailing hulls of at least one the trailing hull pairs, the system of walls extending longitudinally along the length of its associated trailing hull, forming a lateral wall construction to the effect of compensating for the longitudinal and compression differential movement of the platform relative to the relevant trailing hulls.

11. A watercraft according to claim 10 in which the system of flexible walls comprises a plurality of overlapping slats of which each slat extends downwards and rearwards from a first compound hinge point situated on the platform, to a second compound hinge point situated on the relevant hull, with the hinge points being configured to accommodate lateral and longitudinal pivoting of the slats relative to the platform and its associated trailing hull.

12. A watercraft according to claim 10 in which at least one flap is arranged at the stern of the watercraft to at least partly close off the rear end of a tunnel, that is defined between the underside of the platform and across the stern ends of the flexible walls, with the free end of the at least one flap coming into contact with an associated trailing hull when the latter undergoes substantial displacement from its neutral position, thus, when the craft is in use, causing the flap to be lifted clear of oncoming erratic water.

13. A watercraft according to claim 12 wherein the at least one flap includes a spring and damper unit located between the platform and its free end, that is configured to apply a predetermined force, as generated by the flap, on the end region of the associated trailing hull to the effect of controlling the movement of the relevant flap when it is exposed to displacement by a respective trailing hull, or when the flap comes in contact with oncoming erratic water once the craft is in use.

* * * * *